US005437139A

United States Patent [19]

Martin

[11] Patent Number: 5,437,139

[45] Date of Patent: Aug. 1, 1995

[54] CAPPING MACHINE HEAD WITH CAP ALIGNING CHUCK

[75] Inventor: Wendell S. Martin, Fort Smith, Ark.

[73] Assignee: Anderson-Martin Machine Co., Fort Smith, Ark.

[21] Appl. No.: 126,704

[22] Filed: Sep. 21, 1993

Related U.S. Application Data

[63] Continuation-in-part of Ser. No. 787,011, Nov. 4, 1991, Pat. No. 5,313,765.

[51] Int. Cl.[6] ..... B67B 3/20

[52] U.S. Cl. ..... 53/317; 53/331.5

[58] Field of Search ..... 53/317, 331.5, 367

[56] References Cited

U.S. PATENT DOCUMENTS

| | | | |
|---|---|---|---|
| 1,835,335 | 12/1931 | Risser | 53/317 |
| 1,856,827 | 5/1932 | Carruthers . | |
| 2,076,631 | 4/1937 | Gantzer | 53/317 |
| 3,212,231 | 10/1965 | Pechmann | 53/317 |
| 3,405,499 | 10/1968 | Dexter | 53/331.5 |
| 3,491,516 | 1/1970 | Bergeron | 53/317 |
| 3,906,706 | 9/1975 | Conti | 53/331.5 |
| 3,955,341 | 5/1976 | Wilhere | 53/331.5 |
| 3,984,965 | 10/1976 | Sonnenberg | 53/331.5 |
| 4,309,859 | 1/1982 | Schindel | 53/331.5 |
| 4,364,218 | 12/1982 | Obrist | 53/331.5 |
| 4,485,609 | 12/1984 | Kowal | 53/331.5 |
| 4,558,554 | 12/1985 | Herbert | 53/331.5 |
| 4,599,846 | 7/1986 | Ellis et al. | 53/331.5 |
| 4,616,466 | 10/1986 | Tanaka et al. | 53/75 |
| 4,658,565 | 4/1987 | Westbrook et al. | 53/317 X |
| 4,674,263 | 6/1983 | Kelly | 53/317 |
| 4,756,137 | 7/1988 | Lanigan | 53/317 X |
| 4,765,119 | 8/1988 | Aidlin et al. | 53/317 X |
| 4,905,447 | 3/1990 | Margaria | 53/317 |
| 4,979,350 | 10/1990 | Arnemann | 53/331.5 |
| 5,054,261 | 10/1991 | Gilbertson | 53/331.5 |
| 5,197,258 | 3/1993 | Johanek | 53/317 |

*Primary Examiner*—John Sipos
*Assistant Examiner*—Daniel Moon
*Attorney, Agent, or Firm*—Robert R. Keegan

[57] ABSTRACT

There is disclosed a capping machine head for affixing screw caps on containers, which in one embodiment has a cylindrical magnet ring in the body of the head surrounding a cap chuck driving element in a low friction bearing in the head, each having an array of permanent magnets, preferably about fifty or more in number, distributed around their periphery. For certain angular relative positions of the ring and the chuck driving element, the north poles of one are face-to-face with the south poles of the other; displacement from such position causes torque on the order of tell to twenty inch pounds to be imparted to the chuck driving element. The chuck driving element rotates with the magnet ring until the resistance of a cap being threaded on the container exceeds a predetermined torque limit, after which the magnet ring rotates relative to the essentially stationary chuck driving element. The ring magnets may be in an axially misaligned position to reduce and control maximum torque value. Preferably the flux pattern of the magnets is elongated in an axial direction, by providing two rows of cylindrical magnets, or magnets which are elongated in that direction. The spring for urging the chuck downward is fully contained within the head. The chuck portion of the head has a plastic cap receiver with a relatively shallow toothed section spaced outwardly from an annular intrusion limiting shoulder; the receiver cylinder in the vicinity of the toothed section has little or no taper.

14 Claims, 2 Drawing Sheets

CAPPING MACHINE HEAD WITH CAP ALIGNING CHUCK

CROSS-REFERENCE TO RELATED APPLICATION

This application is a continuation-in-part of Wendell Martin application Ser. No. 07/787,011 filed Nov. 4, 1991 U.S. Pat. No. 5,313,765.

BACKGROUND

The present invention relates to capping machines for affixing plastic screw closures on glass or plastic containers for beverages or the like. More particularly it relates to the head portions of a capping machine which serve to rotate the plastic screw cap with respect to the container while pressing on the cap and applying a limited predetermined tightening torque to the cap as controlled by an internal slip clutch.

The development of capping machine heads has been impelled in considerable part by the changes in closures which have progressed from the traditional crowns, to roll on aluminum caps, then to plastic screw caps. With the advent of plastic screw caps with peripheral serrations, it became important to provide the capping machine heads with a slip clutch or other means so that the rotation of the upper part of the head with the spindle after the screw cap was tightly seated would not impart excessive torque causing the cap to be over-tightened or broken. Such caps usually have serrations or teeth positively engaged by matching teeth of the cap chuck. Although some such clutches were friction slip clutches, in recent years, magnetic clutches or magnetic drives-frequently have been employed to control the torque applied to the screw caps.

Numerous patents showing related subject matter in the field of capping machine heads is cited in the current application Ser. No. 07/787,011, but these patents generally show a form of chuck and cap receiver in which the sides of the receiver are tapered not only at the opening end but throughout the depth of the cap receiver. Furthermore, those related patents generally do not show a cap receiver having a relatively wide shoulder which acts as a stop and abutment for the top of the screw cap to assure its coaxial alignment. U.S. Pat. No. 4,558,554 to James F. Herbert, issued Dec. 17, 1985 (Cl.53/331.5) shows a capping head with a cap receiver 27 having a somewhat-tapered internally serrated member 30. The collet (projection) of Herbert has a shoulder (not numbered) but such shoulder is generally occluded by the serrated member 30 and does not appear to function as a stop for the screw cap.

In the apparatus of the invention a conventional plastic cap with a serrated peripheral surface is positively gripped by the receiver of the chuck portion having a relatively shallow toothed section spaced from an intrusion limiting shoulder; the receiver cylinder in the vicinity of, the toothed section has little or no taper.

SUMMARY

The screw closure capper head according to the present invention has a different structure which provides significant advantages, particularly in the cap receiver and chuck portion of the machine head. The capping machine head of the present invention is characterized by a cap aligning chuck with essentially untapered toothed sides and a cap stabilizing shoulder. A magnetic clutch for torque control is preferably in the form of concentric cylindrical configurations of about twenty-four to sixty magnets each with their north-south magnetization oriented radially.

In addition to providing the features and advantages discussed above, it is an object of the present invention to provide a head for a machine-for affixing serrated screw closures on containers wherein the coupling between the machine spindle and the screw cap chuck is provided by magnetic forces and the chuck has teeth with appropriate spacing to firmly grip a cap to prevent relative rotation therebetween while allowing ready entry of the cap into the chuck to a predetermined coaxial position determined by a shoulder in the chuck against which the top of the cap abutts.

It is another object of the present invention to provide such a head for a capping machine wherein the interior toothed portion of the chuck cylinder is essentially untapered thereby substantially precluding non-coaxial positioning of the cap in the chuck.

It is yet another object of the invention to provide such a head wherein the interior toothed portion of the chuck cylinder operates substantially outside of the expansion zone of the cap to prevent undesirable jamming and retention of the cap, or of portions of the cap.

Other objects and advantages of the present invention will be apparent from consideration of the following description in conjunction with the appended drawings in which:

DESCRIPTION OF THE PREFERRED EMBODIMENTS

Figure 1:
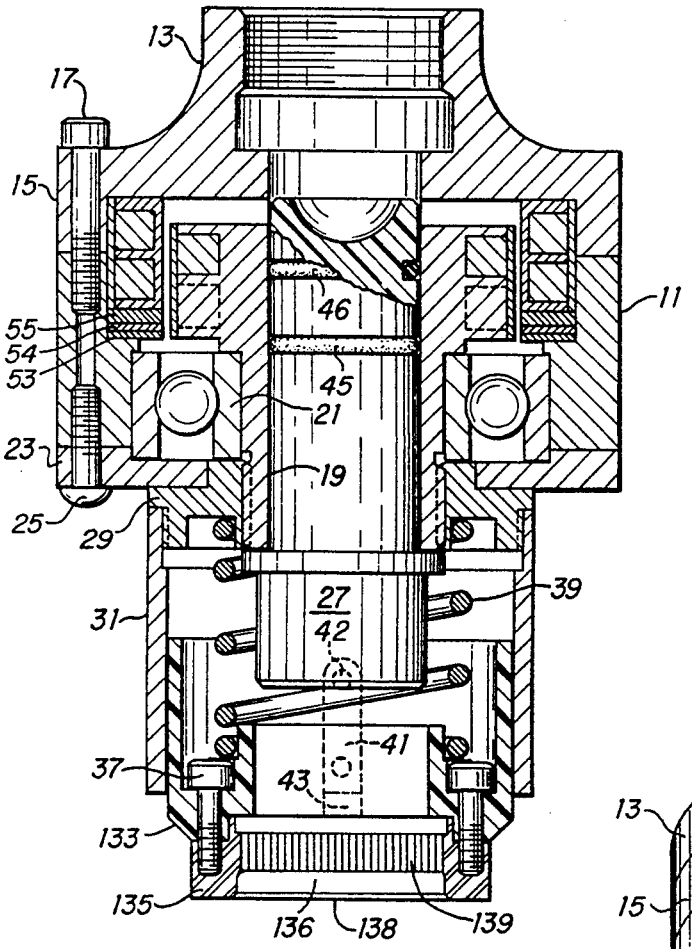
FIG. 1 is a vertical sectional view of a capping machine head with magnetic clutch and preferred embodiment of a tilt preventing cap chuck.
Figure 2:
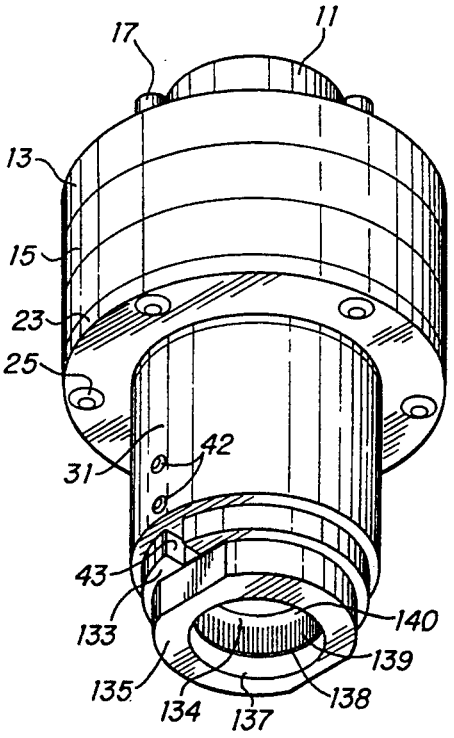
FIG. 2 is a perspective view thereof.

Referring now to the drawings, and particularly FIGS. 1, 2, 3, and 4, a head 11 for a capping machine is shown incorporating features of the present invention. The improved head 11 according to the invention is suitable for and intended for use on conventional plastic screw cap affixing machines described in patents mentioned above or in commercial machines such as the Alcoa 200 Series. The heads described here may be employed on machines where the plastic cap is fed to and placed on top of the bottle mouth prior to the head descending and engaging the cap, or alternatively, with slight modification, with cap-in-head type machines in which the caps are fed to the chuck of the head, and thereafter fitted on the bottle.

Head 11 includes a spindle connector 13 appropriately threaded to be secured on a capping machine spindle and a body 15 removably secured to spindle connector 13 by suitable fasteners, such as machine screws 17. A clutch element 19 is rotatably mounted in body 15 by means of a low friction bearing, such as ball bearing 21, and secured by bearing nut 29.

A bearing retainer plate 23 secures the outer portion of bearing 21 in position in body 15 while bearing nut 29 secures 19, the inner portion of bearing 21 relative to clutch element Bearing nut 29 threadedly engages the lower portion of clutch element 19, and retainer plate 23 is secured on the body of 15 by suitable fasteners such as machine screws 25. Extending through the central opening in clutch element 19 is a cap elector 27 which is operated in an appropriately timed sequence by an operating mechanism extending through the capping machine spindle. The cap election apparatus of the head is essentially conventional and forms no part of the present invention.

Bearing nut 29 is externally threaded to receive an internally threaded sleeve 31 which in turn receives cap chuck unit 133 in a telescoping fashion. Chuck unit 133 has secured thereon a demountable cap receiver 135 secured in place by machine screws 37. Other forms of similar cap receivers 135 can be secured on chuck unit 133 to accommodate a variety of cap sizes or shapes. Cap receiver 135 is a cap-on-bottle form of receiver, and, thus, has no means to capture and frictionally engage a cap received from a cap feeder mechanism while head 11 is descending on the container mouth. An O-ring or other means could be provided to serve that purpose in a cap-in-head system, as shown in parent application Ser. No. 07/787,011, FIGS. 1–3 incorporated herein by reference. It is important to note that the central opening in the bottom of chuck unit 133 has a diameter less than the opening for receiving a cap in cap receiver 135 so that the received cap seats against a shoulder 134 in chuck unit 133 thereby assuring its proper orientation and avoiding any tilting or other misalignment as the cap is tightened on a container.

Shoulder 134 can be integrally formed as a portion of chuck unit 133 or cap receiver 135. Shoulder 134 should be composed of a rigid material, either a metallic substance or a hard plastic resin to ensure proper seating of the received cap. Shoulder 134 is substantially perpendicular to the chuck axis for proper orientation of the received cap. A toothed portion 139 is provided in cap receiver 135 which is spaced by about three to four millimeters (or about ⅛ inch) from shoulder 134. Preferably the cap receiver 135 has a greater diameter in the region of the space 140 from one to six millimeters greater, for example.

It is also very important that receiver 135 is not substantially tapered in the toothed portion 139 whereby all caps will fully insert against shoulder 134 rather than being caught by toothed portion 139 in a possibly tilted position. There is a smooth tapered (untoothed) entry portion 136 of the cap receiver 135 which has a small taper 138 of about 45° for smooth entry of a cap.

Entry portion 136 is about eight to twelve millimeters deep with a taper depth of about one to three millimeters; its diameter may be about 31 millimeters for small (28 millimeters nominal) caps and about 41 millimeters for large (38 millimeters nominal) caps, for reasons later explained.

The taper 138 preferably extends for a depth of less than 1/6 the total depth of the cap receiver and preferably extends for approximately ¼ of the total depth of the entry portion 136. Entry portion 136 comprises the outermost ⅓ of the cap receiver 135. Toothed portion 139 extends for about the middle ⅓ of the depth of the cap receiver.

It is important that toothed portion 139 not extend into about ⅓ of the outermost portion of the cap receiver 133 to avoid the expansion zone of a typical plastic screw cap. For the same reason entry portion 136 is of slightly (two to four millimeters) larger diameter than toothed portion 139 to accommodate cap expansion without causing caps to jam in the cap receiver 135.

Optional recess 140 helps keep the toothed portion 139 free from debris by allowing the subsequent introduction of a cap to push any captured debris up and away from toothed portion 139. Upon the exit of the cap, the freed debris will fall away from the cap receiver 133 and pose no further hindrance to its operation.

Figure 3:
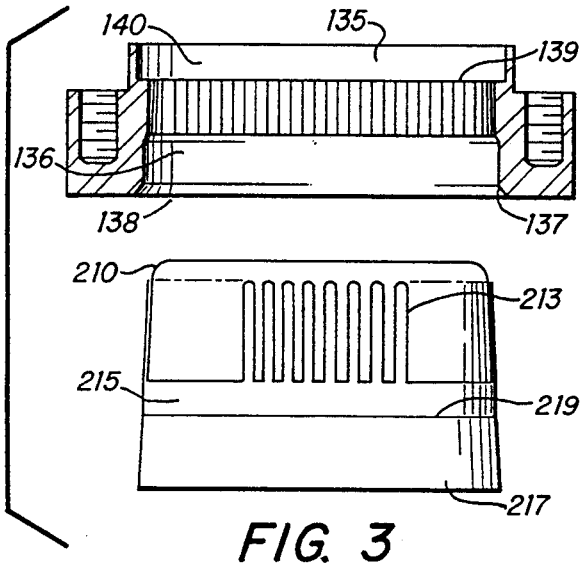
FIG. 3 is an enlarged exploded view of the cap receiving and engaging element of FIGS. 1 and 2 and typical cap showing their relation.
Figure 4:
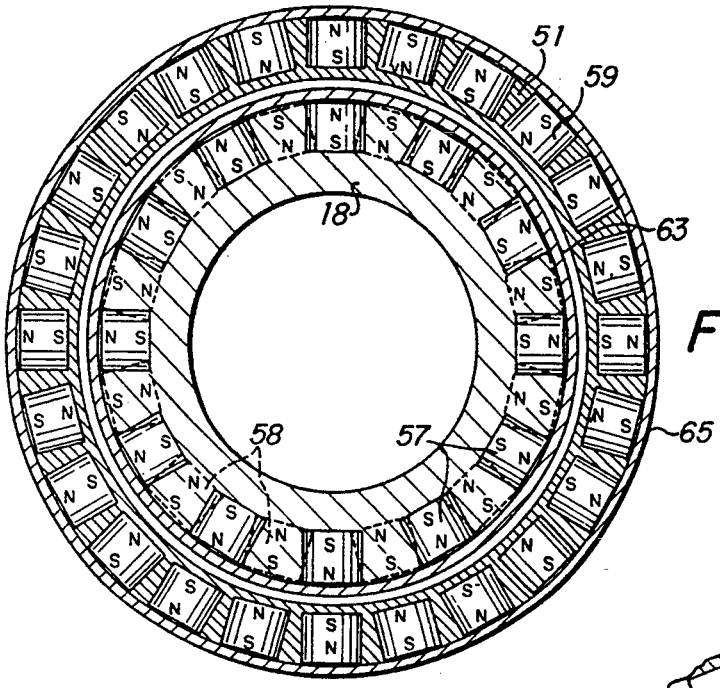
FIG. 4 is a partially schematic sectional view showing the arrangement of the magnet array in the apparatus of FIGS. 1 and 2.

As shown in FIG. 3, a cap receiver 135 is configured for cooperation with a particular size of cap 210 to provide the relationships described above.

The intrusion of cap 210 into the receiver 135 is limited by shoulder 134 which also assures coaxial positioning of cap 210 in receiver 135. Recess 140 may be provided so that plastic dust or fragments do not accumulate in the space between the teeth and the-tooth portion 139 of the receiver 235.

Tooth portion 239 is not deep enough to grip more than about the top ⅓ of cap 210 leaving an untoothed and slightly recessed portion 136 of the receiver with an axial depth great enough to avoid engagement of the lower part of the tooth portion 213 of cap 210, or of the untoothed bottom portion 225 of cap 210 or of the frangible ring 217 of cap 210. Almost all screw cap closures now include a frangible ring 227 or similar feature for tamper detection. Such rings 217 are separated from the bottom portion 215 of the cap proper by a break-line 219 constituting a weakened area of the plastic.

The relationship between the receiver internal structure and the cap 210 as shown in FIG. 3 provides maximum assurance that as the receiver 135 is lowered on to the cap 210 on top of the bottle the cap will be received and seated in-the receiver 135 in a coaxial position properly engaging the tooth portion 139. Furthermore as the cap is tightened, which commonly causes expansion of the lower portion of the cap 215 the corresponding diameter of the receiver 135 is sufficiently great to prevent any binding or gripping of the cap and resulting problems in ejecting the cap 220 from the receiver 235.

Chuck unit 133 is free to slide up and down in sleeve 31 and is urged to a downward position with a desired predetermined force by coil spring 39. The spring constant for spring 39 may be from sixty to eighty pounds-per-inch and is generally not critical. However, the compression force may be changed as desired by the simple expedient of replacing spring 39 with a spring of the desired spring constant, Rotational motion of chuck unit 33 relative to sleeve 31 is constrained by guide rails 41 secured on the interior of sleeve 31 by screws 42, the rails 41 being dimensioned to slide in slots 43 in chuck unit 33. O-ring seals 45 and 46 are provided to protect the interior of the clutch mechanism from intrusion of liquids or other foreign material in accordance with conventional practice. A magnet ring 51 is mounted in body 15 and it is retained in place by spindle connector 13. Spacer rings 53, 54, and 55 occupy the space within body 15 and connector 13 so that magnet ring 51 is positioned and restrained vertically. Spacer rings 53, 54, 55, or any selected ones of them may be removed from on top of magnet ring 51 and placed below magnet ring 51, thereby shifting the vertical position of magnet ring 51 within body 15 to permit adjustment of the torque exerted by the magnetic clutch mechanism.

A magnet ring 18 resides within and concentric with magnet ring 51, and forms a part of clutch element 19. Ring 18 is shown integral with clutch element 19, but may be formed separately and affixed to clutch element 19 in any suitable fashion.

Embedded in magnet ring 51 are a multiplicity of cylindrical bar magnets 59. Ring 51 is formed of nonmagnetic metal or plastic and magnets 59 are peripherally north inward and south inward alternately. Magnet ring 18 is also formed of nonmagnetic material, but in the case where ring 18 is separate from clutch element 19, the latter can be formed of magnetic material. Magnet ring 18 has two tiers of a multiplicity of magnets 57 and 58 embedded therein. A retainer band 65 is provided for magnet ring 51 which may be of magnetically permeable material. Magnet ring 18 may be provided with a magnet retaining ring 63 of aluminum or other non-magnetic material.

In practice there is also a torque produced by the deceleration of the rotating portion of the head as the chuck comes to a stop. It is desirable that this inertia effect be kept to a relatively low value since it is not readily subject to adjustment or control. The apparatus of the invention disclosed in FIGS. 1–4 provides relatively low inertia because the rotating ring associated with the chuck is the internal ring with a lesser radius than the external ring. This reduction in radius is important because the moment of inertia of an annulus is generally proportional to the fourth power of the radius.

The adjustment of torque in the present apparatus is achieved by vertical displacement of ring 51 relative to ring 18. The three spacer rings in the illustrated embodiment are of one unit, two units, and four units thickness, thereby giving eight possible displacements, and eight possible torques. By providing a greater number of spacer rings, finer adjustment in torque values could be achieved if desired. Alternatively a screw type adjustment could provide continuous adjustability.

In the embodiments of apparatus shown in FIGS. 1–4, and in fact in any embodiments of the apparatus, it may be found desirable to provide a flux path of high permeability for the magnets of each of the rings 18 and 51.

Figure 5:
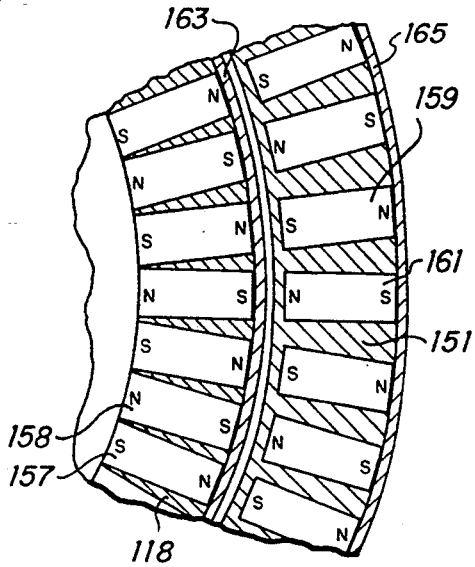
FIG. 5 is an enlarged fragmentary view of alternative forms of magnet arrays representing another preferred embodiment of the invention.
Figure 6:
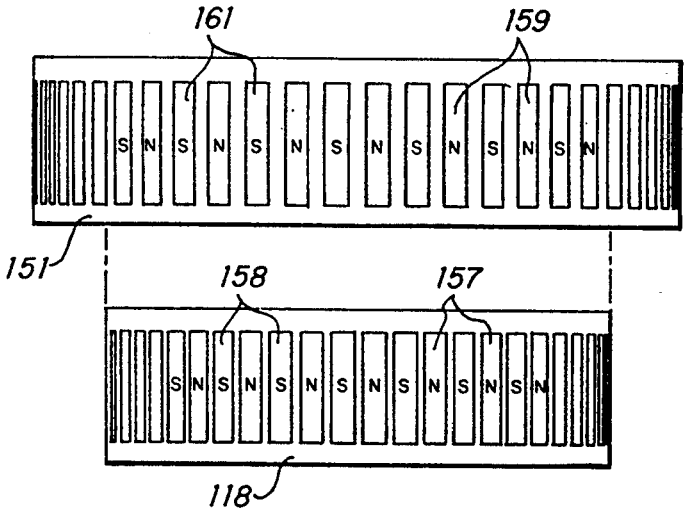
FIG. 6 is an exploded schematic illustration of the magnet rings of FIG. 5.

Referring now to FIGS. 5 and 6, a preferred magnetic clutch embodiment is shown which is a variation on the embodiments of FIGS. 1–4 wherein a pair of magnets in an upper tier and a lower tier is replaced by a single generally rectangular magnet with similar polarization. Thus an internal magnet ring 118 is provided with magnets with outwardly facing north poles 157 and other magnets with outwardly facing south poles 158, while an outer magnet ring 151 is provided with magnets with outwardly facing north poles 159 and magnets 161 with outwardly facing south poles 161.

The narrow configuration of magnets 157 and 158 permit the inner ring 118 to have the same number of magnets as the outer ring 151, which in the embodiment illustrated in FIG. 5 and 6 is fifty magnets in each ring. Although a lesser number of magnets could be used, there is an advantage in the larger number of magnets in that the rotation displacement between neutral torque positions is less, and, thus, the interval during which reverse torque is applied is shorter, thereby reducing any possibility of significant kickback of the receiver which could loosen the cap.

As indicated in FIG. 6, outer magnet ring 151 is displaceable axially from inner ring 118, and, as in the previous embodiments, displacement from the aligned position of rings 151 and 118 reduces the interaction of the magnets and reduces the torque limit for the clutch.

Although a number of variations and modifications to the preferred embodiment of the invention have been shown, described or suggested, other variations and modifications will be apparent to those skilled in the art, and accordingly, the scope of the invention is not to be considered limited to the embodiments shown or suggested, but is rather to be determined by reference to the appended claims.

What is claimed is:

1. A capper head for a screw closure capping machine comprising:

a body;

means for securing said body to a capper machine spindle having an axis;

a chuck driving element rotatably mounted in a low friction bearing in said body with its axis of rotation coaxial with said spindle axis;

a clutch member secured in rotationally fixed position in said body having a means for coupling said chuck driving element to rotate with said body;

a cap chuck with a cap receiver and being affixed to said chuck driving element with limited freedom of axial movement relative thereto, said chuck and cap receiver having a generally cylindrical opening for receiving a serrated screw cap, a single, continuous internally toothed peripheral wall portion of said opening for rotationally engaging said cap and a generally annular shoulder to limit the depth of intrusion of said cap in said receiver, said toothed peripheral wail portion being substantially untapered.

2. Apparatus as recited in claim 1 wherein said cap receiver opening has a tapered outer portion extending no more than about one-sixth of the depth of the opening of said cap receiver.

3. Apparatus as recited in claim 2 wherein said toothed peripheral wall portion of said cap receiver is spaced by at least about one-third of the depth of the opening of said cap receiver from the outer opening of said cap receiver.

4. Apparatus as recited in claim 1 wherein said toothed peripheral wall portion of said cap receiver is spaced by at least about one-third of the depth of the opening of said cap receiver from the outer opening of said cap receiver.

5. Apparatus as recited in claim 4 wherein said toothed peripheral wall portion extends for no more than about one-third of the depth of the opening of said cap receiver.

6. Apparatus as recited In claim i wherein said toothed peripheral wall portion extends for no more than about one-third of the depth of the opening of said cap receiver.

7. A capper head for a screw closure capping machine comprising:

a body;

means for securing said body to a capper machine spindle having an axis;

a chuck driving element rotatably mounted In said body with its axis of rotation coaxial with said spindle axis;

a clutch member secured in rotationally fixed position In said body having a means for magnetically coupling said body to said chuck driving element;

a cap chuck affixed to said chuck driving element, said chuck having a cap receiver with a generally cylindrical opening for receiving a serrated screw cap, a single continuous internally toothed peripheral wall portion of said opening for rotationally engaging said cap, and a shoulder forming a stop sufficiently wide to positively limit the depth of Intrusion of said cap in said receiver and to orient the cap coaxially with said chuck, said toothed peripheral wall portion being substantially untapered.

8. Apparatus as recited in claim 7 wherein said cap receiver opening has a tapered outer portion extending no more than about one-sixth of the depth of the opening of said cap receiver.

9. Apparatus as recited in claim 8 wherein said toothed peripheral wall portion of said cap receiver is spaced by at least about one-third of the depth of the opening of said cap receiver from the outer opening of said cap receiver.

10. Apparatus as recited in claim 7 wherein said toothed peripheral wall portion of said cap receiver is spaced by at least about one-third of the depth of the opening of said cap receiver from the outer opening of said cap receiver.

11. Apparatus as recited in claim 10 wherein said toothed peripheral wall portion extends for no more than about one-third of the depth of the opening of said cap receiver.

12. A capper head for a screw closure bottle capping machine comprising:

a generally cylindrical body;

means for fixedly securing said body to a capper machine spindle having an axis;

a chuck driving element rotatably mounted in a low friction bearing in said body with its axis of rotation coaxial with said spindle axis;

a clutch member secured in rotationally fixed position in said body having a means for magnetically coupling said body to said chuck driving element;

a cap chuck affixed to said chuck driving element, said chuck having a cap receiver with a generally cylindrical openings for receiving a serrated screw cap, a single continuous internally toothed peripheral wall portion of said opening for rotationally engaging said cap, and a generally annular shoulder inwardly from said toothed wall portion forming a stop sufficiently wide to positively limit the depth of intrusion of said cap in said receiver and to orient the cap coaxially with said chuck, said toothed peripheral wall portion being substantially untapered and spaced by at least eight millimeters from the open end of said generally cylindrical opening.

13. Apparatus as recited in claim 12 wherein said cap receiver has a tapered outer portion extending no more than about one-sixth of the depth of said cap receiver.

14. Apparatus as recited in claim 13 wherein said toothed wall portion extends for no more than about one-third of the depth of the opening of said cap receiver.

* * * * *